US011746558B2

(12) United States Patent
Lo

(10) Patent No.: US 11,746,558 B2
(45) Date of Patent: Sep. 5, 2023

(54) POSITIONING DEVICE FOR FENCE SUPPLEMENTED WITH PET GUARDRAIL

(71) Applicant: Xia Shin International Co., Ltd., Tainan (TW)

(72) Inventor: Eric Chen Zer Lo, Tainan (TW)

(73) Assignee: Xia Shin International Co., Ltd., Tainan (TW)

( * ) Notice: Subject to any disclaimer, the term of this patent is extended or adjusted under 35 U.S.C. 154(b) by 133 days.

(21) Appl. No.: 17/558,822

(22) Filed: Dec. 22, 2021

(65) Prior Publication Data

US 2023/0184003 A1 Jun. 15, 2023

(30) Foreign Application Priority Data

Dec. 9, 2021 (TW) ..... 110146077

(51) Int. Cl.
*E04H 17/14* (2006.01)
*E06B 11/02* (2006.01)

(52) U.S. Cl.
CPC ..... *E04H 17/1448* (2021.01); *E04H 17/1439* (2013.01); *E06B 11/025* (2013.01)

(58) Field of Classification Search
CPC ..... E04H 17/166
See application file for complete search history.

(56) References Cited

U.S. PATENT DOCUMENTS

| | | | | |
|---|---|---|---|---|
| 888,905 | A | 5/1908 | Johnson | |
| 1,211,059 | A | 1/1917 | Blank | |
| 1,312,242 | A | 8/1919 | Ferris | |
| 1,386,928 | A | 8/1921 | Hamilton | |
| 1,445,307 | A | 2/1923 | Ferris | |
| 1,764,284 | A | 6/1930 | Barton | |
| 6,832,752 | B2 | 12/2004 | Cuzzocrea | |
| 8,356,801 | B2 * | 1/2013 | Howard | E04H 17/1439 256/22 |
| 9,027,909 | B1 * | 5/2015 | Peyton | E04H 17/1439 256/67 |
| 10,648,194 | B2 * | 5/2020 | Lo | E04H 17/1439 |
| 10,787,838 | B2 | 9/2020 | Larsen | |
| 2016/0208515 | A1 * | 7/2016 | Larsen | E04H 17/1426 |
| 2021/0010290 | A1 | 1/2021 | Larsen | |

FOREIGN PATENT DOCUMENTS

| | | | |
|---|---|---|---|
| CN | 212937287 | U | 4/2021 |
| JP | 2019030243 | A | 2/2019 |

* cited by examiner

*Primary Examiner* — Daniel J Wiley
(74) *Attorney, Agent, or Firm* — Alan D. Kamrath; Karin L. Williams; Mayer & Williams PC

(57) ABSTRACT

Disclosed is a positioning device for a fence supplemented with a pet guardrail. The pet guardrail is fixed to a side of an existing fence in a side-attaching manner, and an upper crossbar and a lower crossbar of the pet guardrail are fixed to an outer side of the existing fence by bolts and covered and protected by front and rear cover plates, and both ends of the upper crossbar and lower crossbar are sheathed with a side sleeve for protection. In this way, the grid spacing of the existing fence can be reduced to prevent pets from escaping, and the overall appearance is aesthetic, and the overall structure avoids people or pets from being scratched by the bolts and just requires simple operations for the installation.

3 Claims, 7 Drawing Sheets

POSITIONING DEVICE FOR FENCE SUPPLEMENTED WITH PET GUARDRAIL

BACKGROUND OF THE INVENTION

Field of the Invention

The present invention relates to a positioning device for a fence supplemented with a pet guardrail, and more particularly to an existing fence supplemented with a pet guardrail, and the construction can be made without changing the structure of the existing fence and the effect of easy positioning can be achieved.

Description of the Related Art

Fence is usually built around a courtyard to prevent trespassing. If the gap between vertical bars or crossbars of the fence is too large, then a pet playing in the courtyard may rush to a road outside the courtyard through the large gap, and the pet may be hit by a car on the road. In order to prevent the pet from rushing out of the fence, a pet guardrail may be added to the bottom of the existing fence to reduce the grid spacing of the existing fence. For example, there are fences supplemented with a pet guardrail as disclosed in U.S. Pat. Nos. 10,787,838, 6,832,752, 1,764,284, 1,445,307, 1,386,928, 1,312,242, 1,211,059, and 888,905.

SUMMARY OF THE INVENTION

It is a primary objective of the present invention to provide a pet guardrail mounted onto an existing fence to reduce the grid spacing at the bottom end of an existing fence to prevent pets from escaping, and the pet guardrails of the invention has the features of easy and simple installation and aesthetic appearance, and the invention further provides a novel positioning device for the fence supplemented with the pet guardrail.

The present invention relates to a pet guardrail, having a side fixed to a side of an existing fence in a side-fitting manner, the pet guardrail comprising an upper crossbar and a lower crossbar arranged from top to bottom and a plurality of straight rods coupled between the upper crossbar and the lower crossbar and fixed by a positioning peg, and wherein a concave embedding port is disposed on a side of the vertical bar of the upper crossbar and the lower crossbar facing the existing fence, and provided for embedding the vertical bar and fixing by a fastener. An upper snap slot and a lower snap slot, concavely formed and axially extended from the outer walls of the front end and the rear end of the top and bottom of the upper crossbar and the lower crossbar respectively, a front cover plate and a rear cover plate, assembled in pairs, being disposed on front and rear sides of the upper crossbar and the lower crossbar respectively, an upper wing plate and a lower wing plate being the upper and lower ends of the front cover plate and the rear cover plate being extended towards ends of the upper crossbar and the lower crossbar respectively, and an upper snap jaw and a lower snap jaw being configured to be corresponsive to the upper wing plate and the lower wing plate respectively and snapped and fixed with the upper snap slot and the lower snap slot of the upper crossbar and the lower crossbar respectively. After being mounted onto the existing fence, the pet guardrail is fixed by fasteners, and then a front cover plate and a rear cover plate are covered onto the fastener and the positioning peg. After the pet guardrail and the existing fence are assembled, the grid spacing of the existing fence can be reduced to prevent the pets from escaping, provide an aesthetic look, and avoid the fastener and the positioning peg from being exposed to the outside or scratched easily. In addition, the invention has an easy and simple installation effect.

The positioning device further comprises a side sleeve, having a lower opening formed at the bottom end of the side sleeve, a side opening formed on a side of the side sleeve, and a lower hook bent from the bottom of the front and rear sides of the lower opening towards an inner side the lower opening, wherein the side sleeve can be sheathed from top to bottom on the front cover plate and the rear cover plate, fixed to an outer side of the upper rear section of the upper crossbar and the lower crossbar, and hooked and fixed to the bottom of the front cover plate and the rear cover plate through the lower hook so as to protect people or pets from being scratched by both sharp ends of the upper crossbar, lower crossbar, front cover plate, and rear cover plate.

DETAILED DESCRIPTION OF THE PREFERRED EMBODIMENTS

Figure 1:
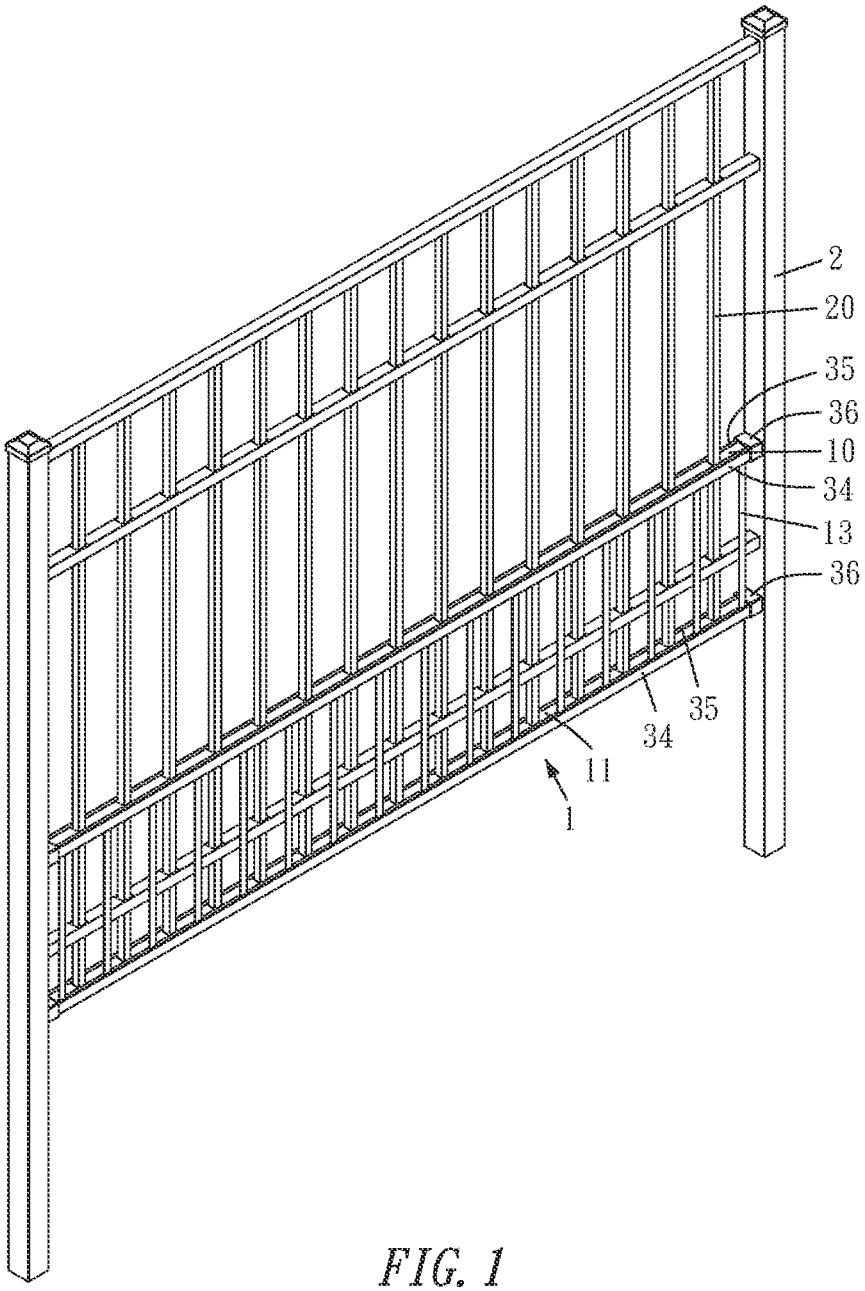
FIG. 1 is a perspective view of an existing fence supplemented with a pet guardrail in accordance with an embodiment of the present invention.
Figure 2:
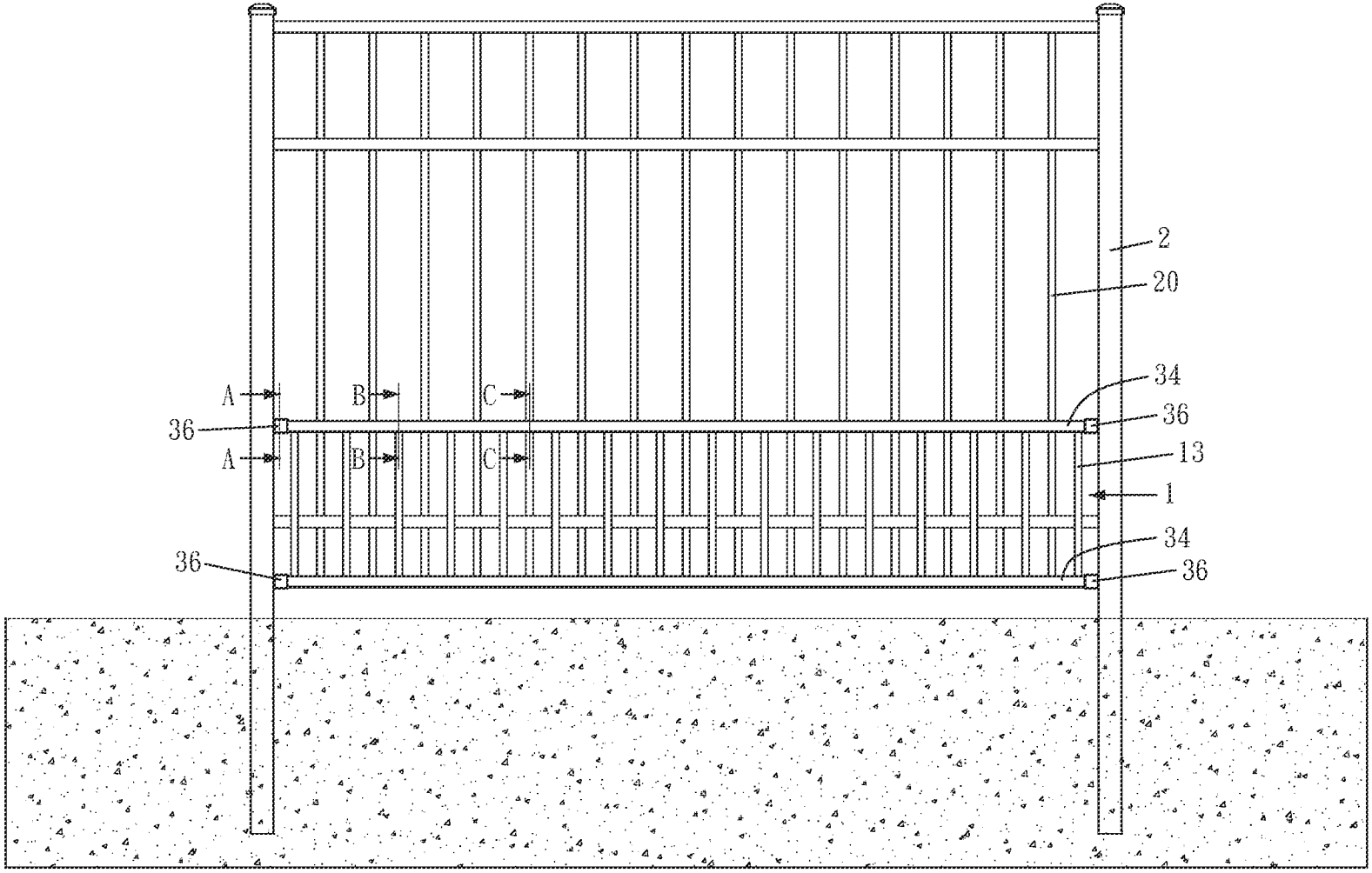
FIG. 2 is a front view of an existing fence before installing a pet guardrail in accordance with an embodiment of the present invention.

The adopted technical means and achievable effects of the present invention will be apparent with the detailed description accompanied with related drawings of preferred embodiments as follows.

With reference to FIGS. 1 to 4 for a pet guardrail 1 fixed to the bottom of a side of an existing fence 2 by a side-attaching and embedding method in accordance with an embodiment of the present invention, the pet guardrail 1 includes an upper crossbar 10 and a lower crossbar 11 arranged from top to bottom, and a positioning peg 12 (such as a bolt or a rivet) fixed to a plurality of straight rods 13 between the upper crossbar 10 and the lower crossbar 11. The pet guardrail 1 is fixed to a positioning device 3 on the existing fence 2 and includes the following parts:

A concave embedding port 30 is disposed on the upper crossbar 10 and the lower crossbar 11 facing a side of a vertical bar 20 of the existing fence 2, and provided for embedding the vertical bar 20 and fixing the vertical bar 20 by a fastener 31 (such as a bolt). An upper snap slot 32 and a lower snap slot 33 (as shown in FIG. 4*a*) are concavely formed on and axially extended from the outer walls of the front end and the rear end of the top and bottom of the upper crossbar 10 and the lower crossbar 11 respectively.

Figure 5:
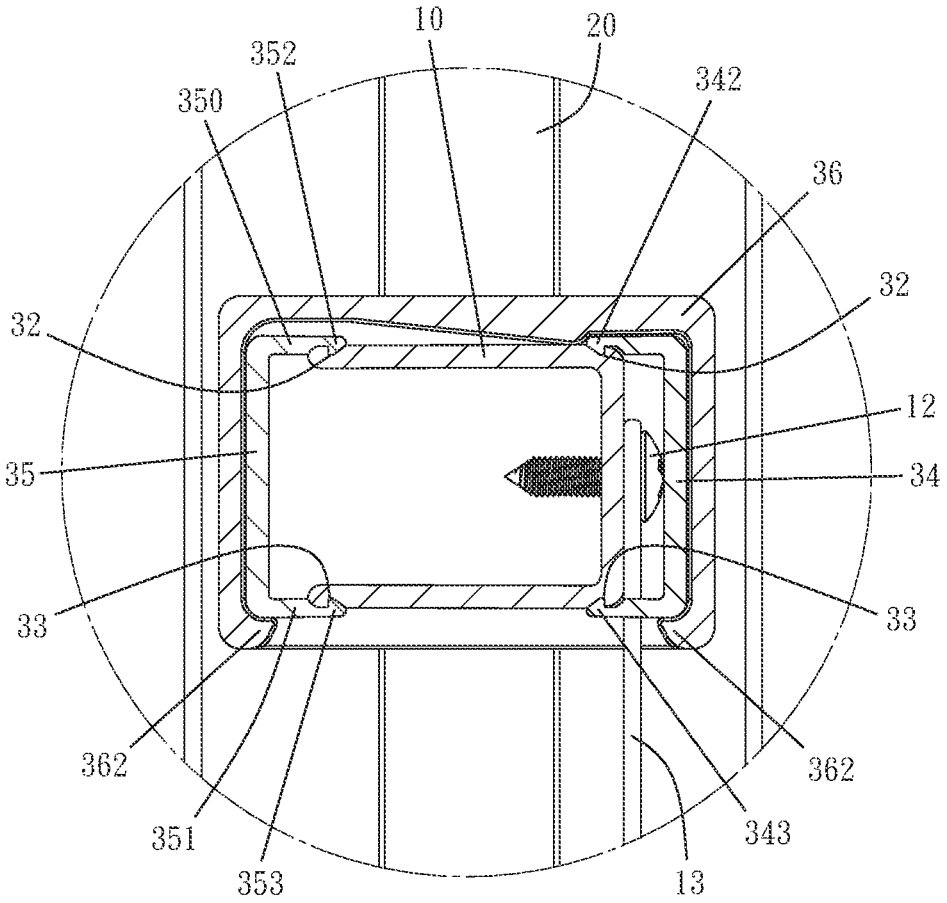
FIG. 5 is a cross-sectional blowup view of Section A-A of FIG. 2.
Figure 6:
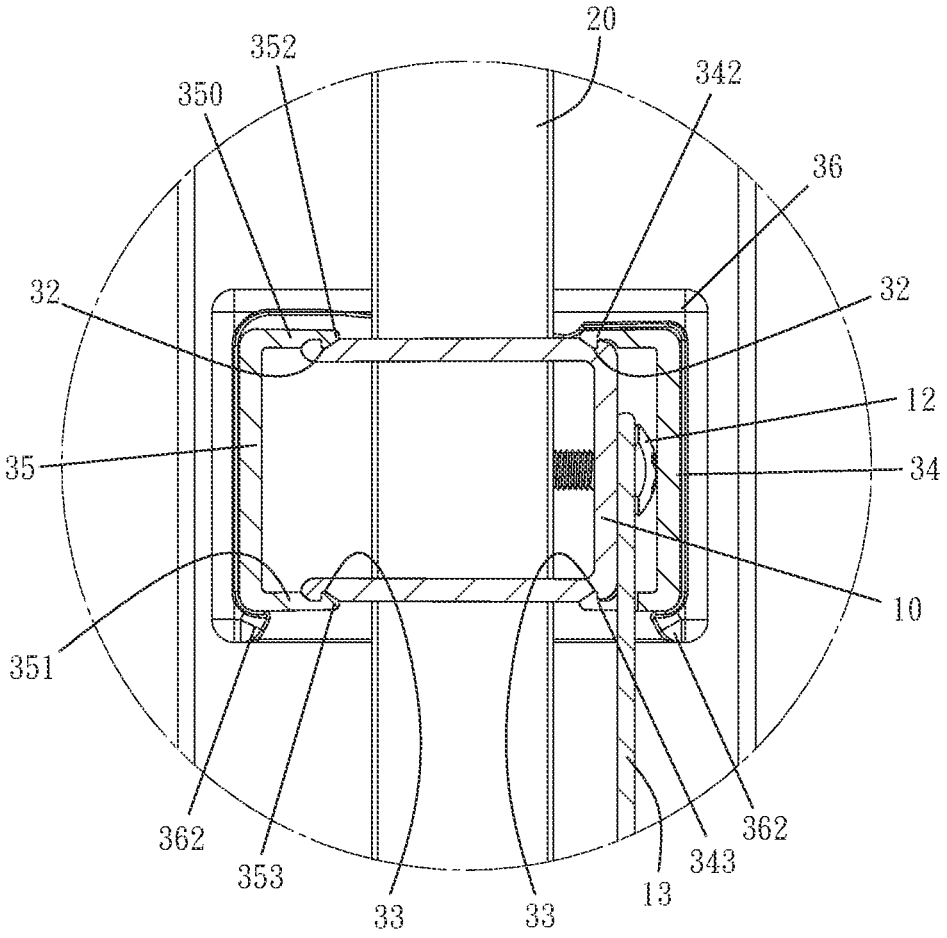
FIG. 6 is a cross-sectional blowup view of Section B-B of FIG. 2.
Figure 7:
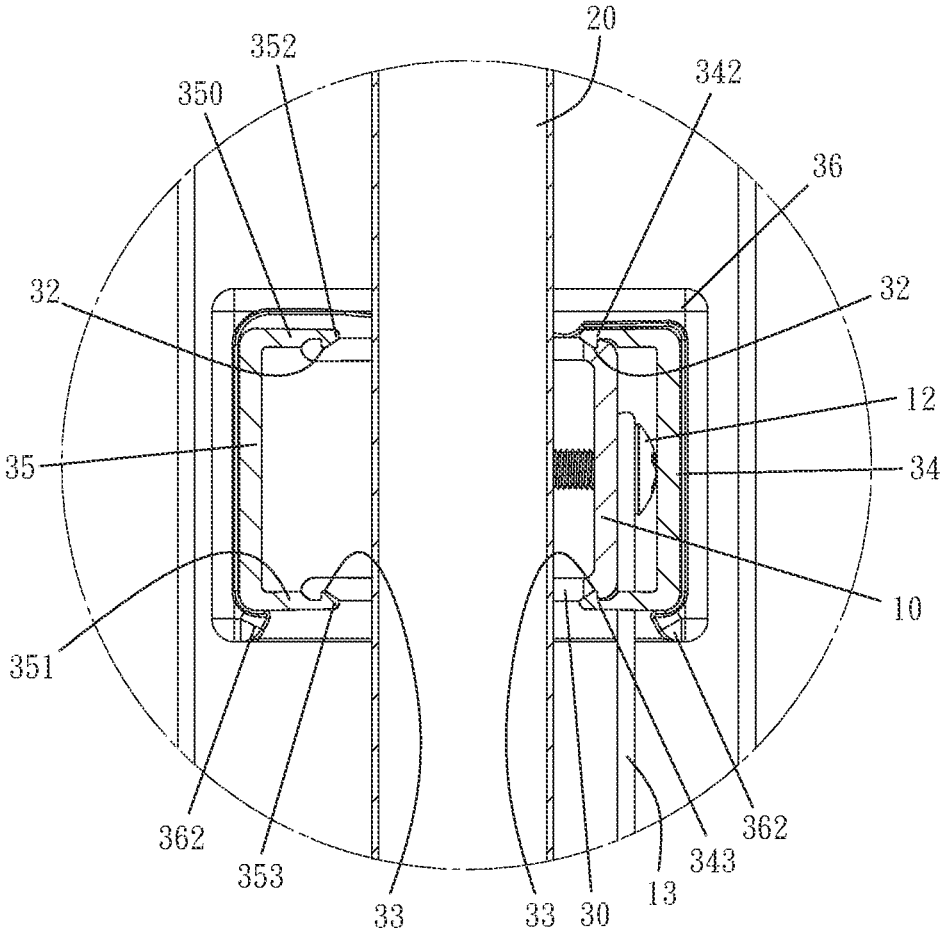
FIG. 7 is a sectional view blowup of Section C-C of FIG. 2.

A front cover plate 34 and a rear cover plate 35 are assembled in pairs, and each pair of the front cover plate 34 and the rear cover plate 35 are disposed on the front and rear sides of the upper crossbar 10 and the lower crossbar 11 respectively. An upper wing plate 340, 350 and a lower wing plate 341, 351 are extended from the upper and lower ends of the front cover plate 34 and the rear cover plate 35 towards the upper crossbar 10 and the lower crossbar 11 respectively, and the corresponding ends of the upper wing plate 340, 350 and the lower wing plate 341, 351 are configured with an upper snap jaw 342, 352 and a lower snap jaw 343, 353 (as shown in FIGS. 4*b* and 4*c*) respectively, and the upper snap jaw 342, 352 and the lower snap jaw 343, 353 are engaged with the upper snap slot 32 and the lower snap slot 33 of the upper crossbar 10 and the lower crossbar 11 respectively, so that after the pet guardrail 1 is embedded into the existing fence 2 and fixed by a fastener 31, the front cover plate 34 and the rear cover plate 35 can cover the fastener 31 and the positioning peg 12 as shown in FIGS. 5, 6 and 7. In addition, the front cover plate 34 disposed on the lower wing plate 341 of the upper crossbar 10 and the upper wing plate 340 disposed on the of the lower crossbar 11 have an inner notch 344 (as shown in FIGS. 4 and 4*b*) on a side facing the straight rod 13 separately, so that when the front cover plate 34 and the straight rod 13 are engaged, the straight rod 13 can be embedded into the inner notch 344 to provide a flat and smooth assembly.

Figure 4:
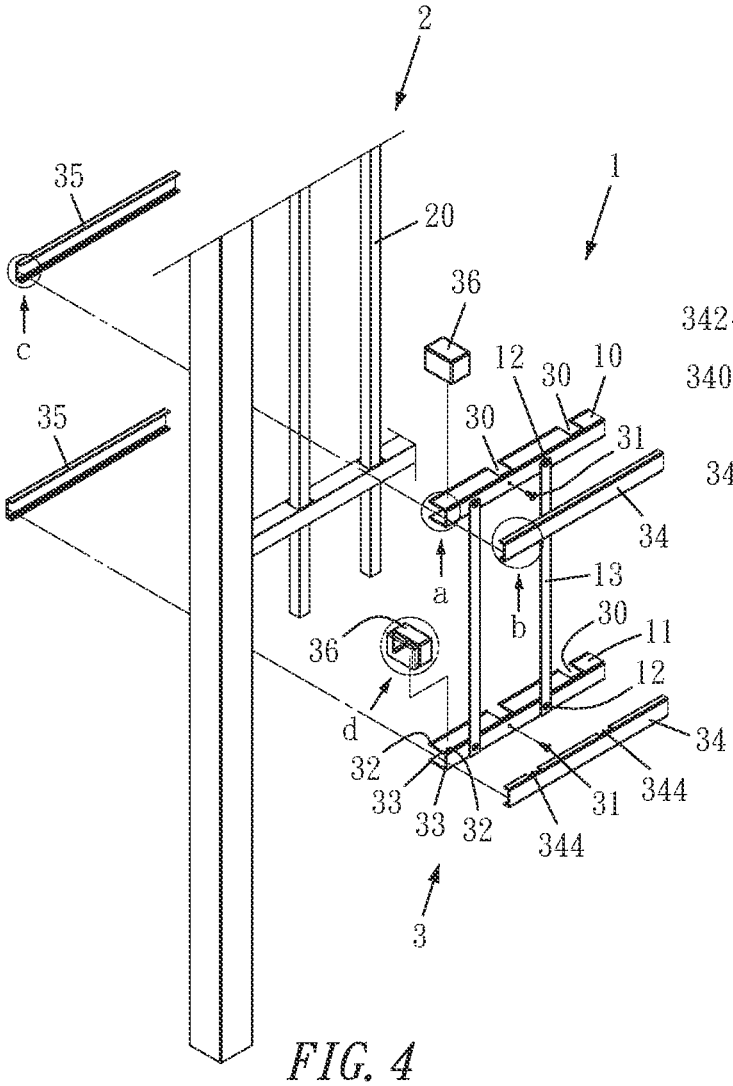
FIG. 4 is a partial blowup view of FIG. 3.
Figure 4A:
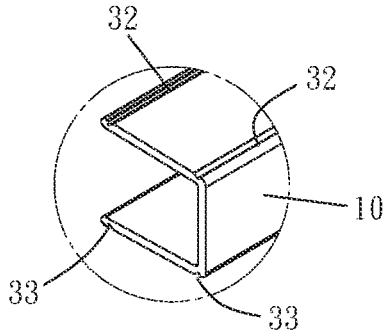
FIG. 4*a* is a blowup view of Part a of FIG. 4.
Figure 4B:
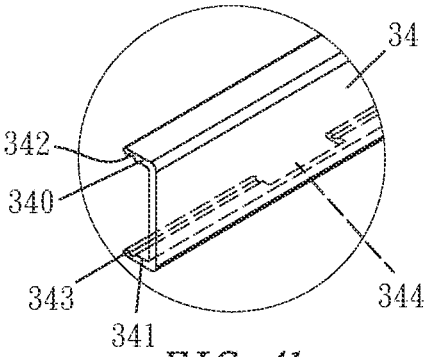
FIG. 4*b* is a blowup view of Part b of FIG. 4.
Figure 4C:
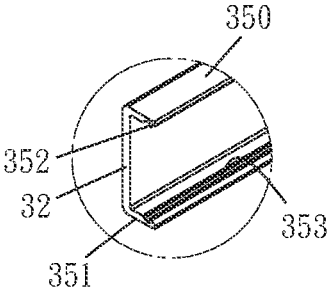
FIG. 4*c* is a blowup view of Part c of FIG. 4.
Figure 4D:
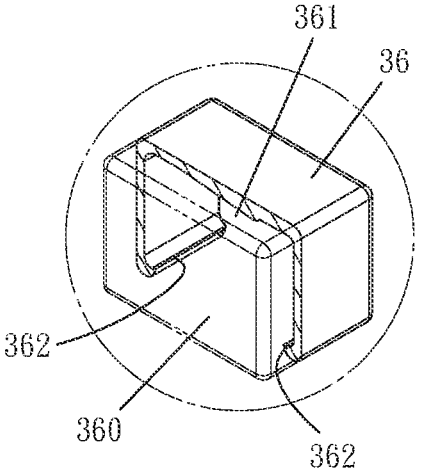
FIG. 4*d* is a blowup view of Part d of FIG. 4.

The pet guardrail 1 has a side sleeve 36 (as shown in FIGS. 4 and 4*d*) sheathed on both left and right ends of the upper crossbar 10 and the lower crossbar 11 respectively. The side sleeve 36 has a lower opening 360 formed at a bottom end of the side sleeve 36 and a side opening 361 formed on a side of the side sleeve 36, and a lower hook 362 is bent from the bottom end of the front and rear sides of the lower opening 360 towards the inner side of the lower opening 360, so that the side sleeve 36 can be sheathed from top to bottom on the front cover plate 34, and the rear cover plate 35 is fixed to the outer side of the upper rear section of the upper crossbar 10 and lower crossbar 11, and engaged and fixed to the bottom of the front cover plate 34 and the rear cover plate 35 by a lower hook 362 (as shown in FIGS. 5, 6 and 7) to protect people or pets from being scratched by the sharp ends of the upper crossbar 10, the lower crossbar 11, the front cover plate 34 and the rear cover plate 35.

Figure 3:
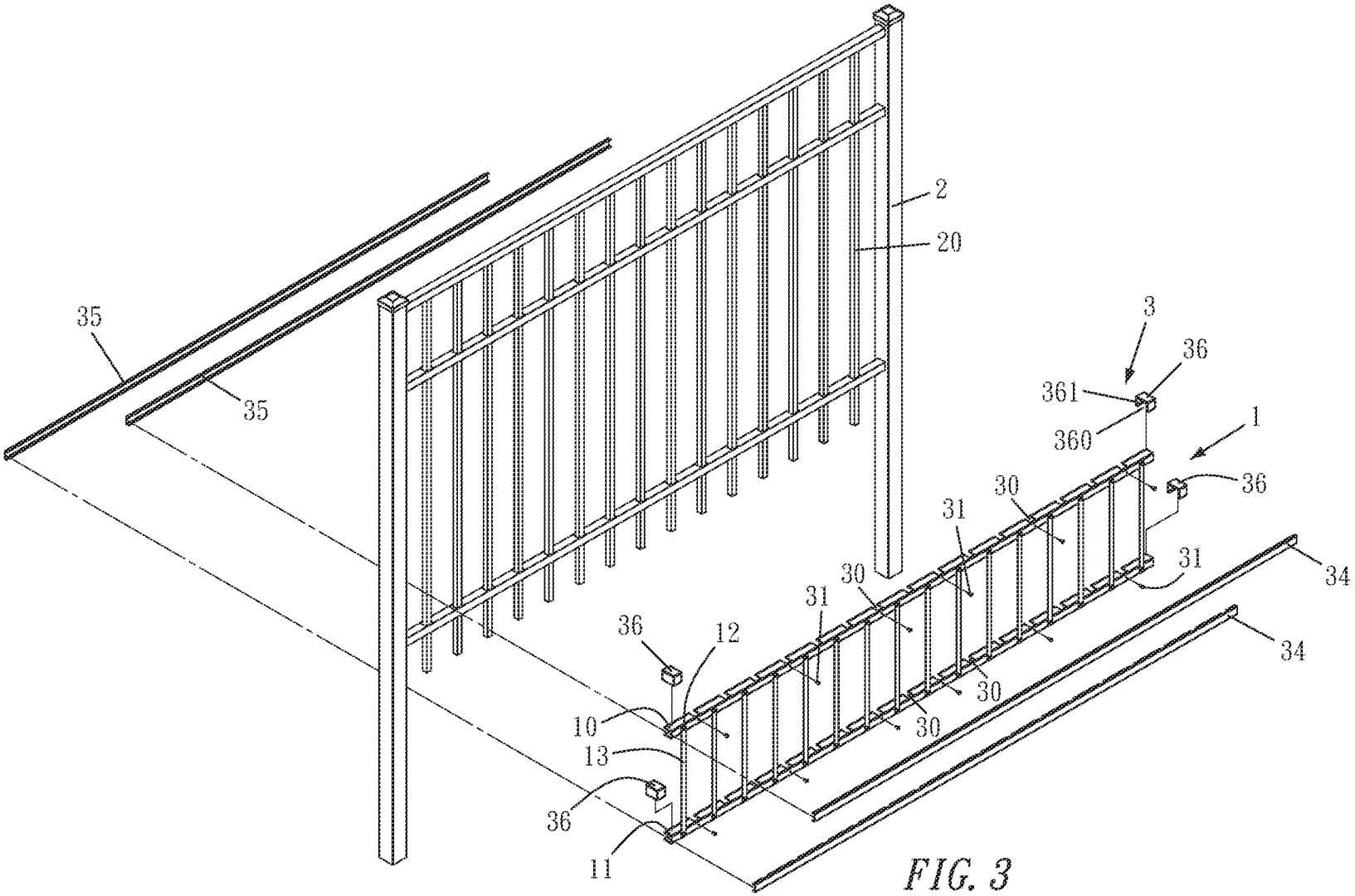
FIG. 3 is an exploded view of an existing fence supplemented with a pet guardrail in accordance with an embodiment of the present invention.

When a user wants to add and fix the pet guardrail 1 to the bottom end of the existing fence 2 as shown in FIG. 3, a side of the pet guardrail 1 is attached to the bottom end of the existing fence 2, and the embedding ports 30 of the upper crossbar 10 and the lower crossbar 11 are provided for embedding the vertical bar 20, and the plurality of fasteners 31 is provided for fixing the upper crossbar 10 and the lower crossbar 11 to the vertical bar 20, so that the pet guardrail 1 can be fixed to a side of the bottom end of the existing fence 2, and the straight rod 13 is passed and installed between every two adjacent vertical bars 20 to reduce the grid spacing of the bottom end of the existing fence 2. The front over plate 34 and the rear cover plate 35 are attached to the front and rear sides of the upper crossbar 10 and the lower crossbar 11 respectively, and the upper snap jaw 342, 352 and the lower snap jaw 343, 353 of the front cover plate 34 and the rear cover plate 35 are engaged and fixed with the upper snap slot 32 and the lower snap slot 33 of the upper crossbar 10 and the lower crossbar 11 respectively to cover and protect the fastener 31 and the positioning peg 12 as shown in FIGS. 5, 6 and 7. Finally, the side sleeve 36 is sheathed from top to bottom on the front cover plate 34, and the rear cover plate 35 is fixed to an outer side of the upper rear section of the upper crossbar 10 and the lower crossbar 11 to prevent people or pets from being scratched by the sharp ends of the upper crossbar 10, the lower crossbar 11, the front cover plate 34, and the rear cover plate 35.

From the description above, the operation of mounting the pet guardrail 1 of the present invention onto the existing fence 2 is simple, easy, and convenient.

While the present invention has been described by means of specific embodiments, numerous modifications and variations could be made thereto by those skilled in the art without departing from the scope and spirit of the invention set forth in the claim.

What is claimed is:

1. A positioning device for a fence supplemented with a pet guardrail, and the pet guardrail having a side fixed to the bottom of a side of an existing fence by the positioning device in a side-fitting and embedding manner; and the pet guardrail comprising an upper crossbar and a lower crossbar arranged from top to bottom and a plurality of straight rods coupled between the upper crossbar and the lower crossbar and fixed by a positioning peg; and the positioning device comprising:

a concave embedding port, disposed on a side of each vertical bar of the upper crossbar and the lower crossbar facing the existing fence, and provided for embedding the vertical bar and fixing by the upper crossbar and the lower crossbar with the existing fence by a fastener; and an upper snap slot and a lower snap slot, concavely formed and axially extended from the outer walls of the front end and the rear end of the top and bottom of the upper crossbar and the lower crossbar respectively;

a front cover plate and a rear cover plate, assembled in pairs, and each pair of the front cover plate and rear cover plate being disposed on front and rear sides of the upper crossbar and the lower crossbar respectively; an upper wing plate and a lower wing plate being the upper and lower ends of the front cover plate and the rear cover plate being extended towards ends of the upper crossbar and the lower crossbar respectively, and an upper snap jaw and a lower snap jaw being configured to be corresponsive to the upper wing plate and the lower wing plate respectively and snapped and fixed with the upper snap slot and the lower snap slot respectively; and the front cover plate disposed at the lower wing plate on a side of the upper crossbar and the upper wing plate disposed on a side of the lower crossbar having an inner notch formed on a side facing the straight rod separately, so that when the front cover plate is engaged with the straight rod, the straight rod is embedded into the inner notch.

2. The positioning device for a fence supplemented with a pet guardrail according to claim 1, further comprising a side sleeve disposed at both left and right ends of the upper crossbar and the lower crossbar; a lower opening formed at the bottom end of the side sleeve, a side opening formed on a side of the side sleeve, and a lower hook bent from the bottom of the front and rear sides of the lower opening towards an inner side the lower opening, wherein the side sleeve can b sheathed from top to bottom on the front cover plate and the rear cover plate, fixed to an outer side of the upper rear section of the upper crossbar and the lower crossbar, and hooked and fixed to the bottom of the front cover plate and the rear cover plate through the lower hook.

3. The positioning device for a fence supplemented with a pet guardrail according to claim 1, wherein the positioning peg and the fastener are bolts.

* * * * *